US005334011A

United States Patent [19]

Frigiére

[11] Patent Number: 5,334,011

[45] Date of Patent: Aug. 2, 1994

[54] GAS-FILLED CHILDPROOF LIGHTER

[75] Inventor: René Frigiére, Charbonnieres les Bains, France

[73] Assignee: Cricket, Rilliuex la Pape, France

[21] Appl. No.: 23,210

[22] Filed: Feb. 25, 1993

[30] Foreign Application Priority Data

Feb. 25, 1992 [FR] France ..... 92 02427

[51] Int. Cl.[5] ..... F23D 11/36

[52] U.S. Cl. ..... 431/153; 431/277

[58] Field of Search ..... 431/153, 277

[56] References Cited

U.S. PATENT DOCUMENTS 4,832,596 5/1989 Morris .
5,165,886 11/1992 Frigiere ..... 431/153
5,205,729 4/1993 Iwahori ..... 431/153
5,213,493 5/1993 Iwahori ..... 431/153

FOREIGN PATENT DOCUMENTS 0285748 10/1988 European Pat. Off. .
0345729 12/1989 European Pat. Off. .
WO/9012254 10/1990 World Int. Prop. O. .

*Primary Examiner*—Carroll B. Dority
*Attorney, Agent, or Firm*—Herbert Dubno; Andrew Wilford

[57] ABSTRACT

The means for neutralizing the lever for opening the burner valve consist of a pusher mounted so as to slide under the lower face of the rear end of the control lever and movable between a withdrawn active position in which a part integral with the body of the lighter is situated just below it, making any maneuver of the control lever impossible in the direction for opening the valve, and an advanced and nonobstructing position, in which the aforementioned part of the body of the lighter is no longer in the path described by the pusher when the control lever is maneuvered in the direction for opening the valve, making this maneuver possible, means being provided for ensuring that the pusher is momentarily kept in the nonobstructing position before actuation of the control lever and other means being provided to ensure that it returns to the active neutralization position immediately after this actuation.

17 Claims, 4 Drawing Sheets

FIG 1
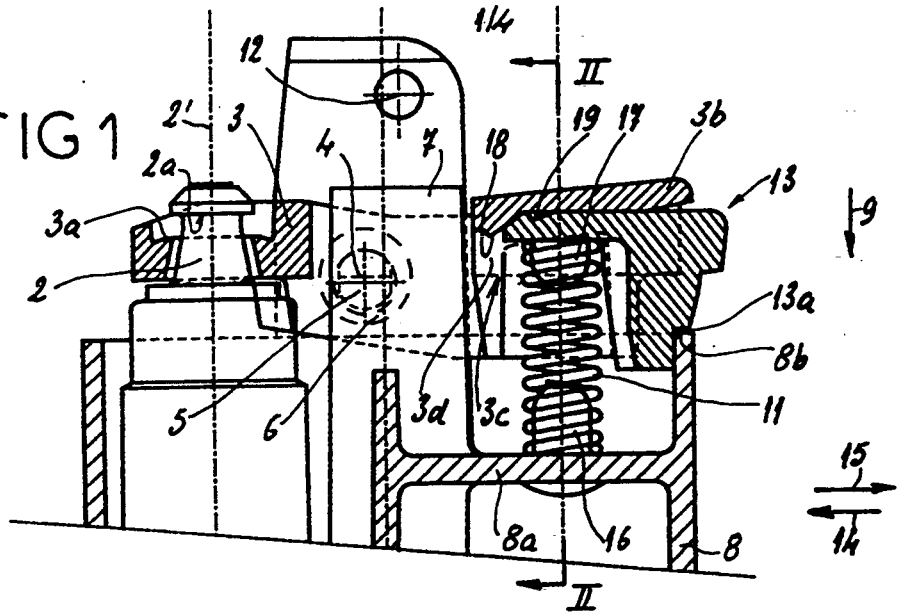
FIG 2
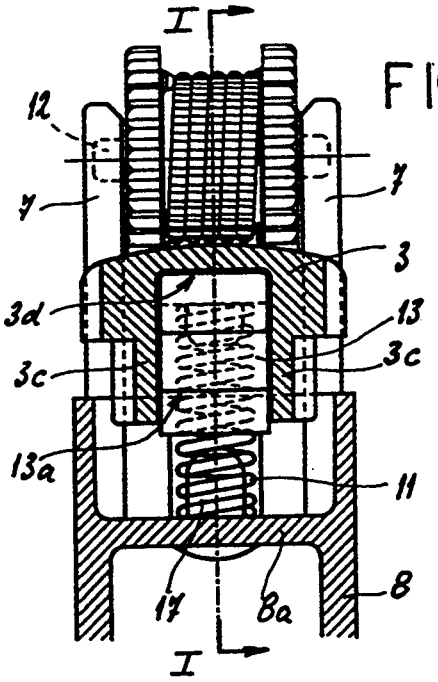
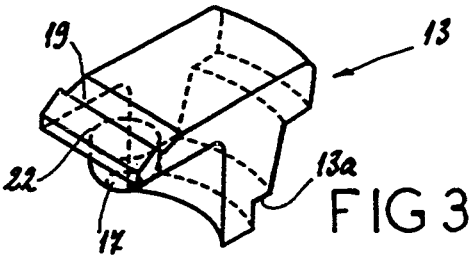
FIG 3
FIG 4
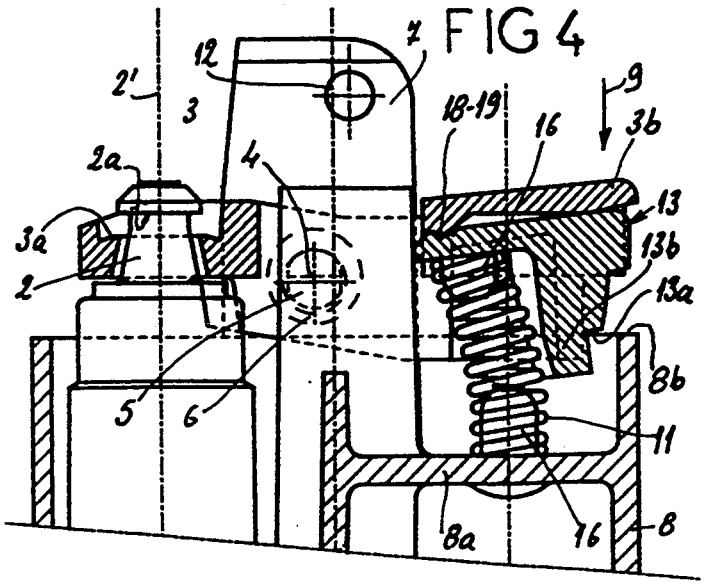

GAS-FILLED CHILDPROOF LIGHTER

BACKGROUND OF THE INVENTION

The present application relates to a gas-childproof lighter, that is to say a lighter in which there are combined with the lighting mechanism means for neutralizing this mechanism, which means are movable between an active neutralization position, in which they prevent the actuation of the lighting mechanism, and a nonobstructing position in which they allow this actuation, these movable means being able to be displaced, manually, by the user, from their active neutralization position to their nonobstructing position.

DESCRIPTION OF THE PRIOR ART

Lighters of the aforementioned type are disclosed in WO-A No. 90/00239 and EP-A No. 0,357,347 in which the means for opening the valve consist of a tilting lever articulated to a fixed pin orthogonal to the axis of the burner valve, one end of which lever, in the shape of a fork or ring, is engaged under a collar of the burner valve and the other end or actuation end of which is intended to be actuated by the user by being pushed in the direction of the body of the lighter, counter to the force of a return spring, the means for producing sparks themselves being independent or combined with the lever for opening the valve, and in which the means for neutralizing the lighting mechanism are normally kept in the neutralization position and are, moreover, arranged so as to be returned automatically into the neutralization position after actuation of the lighting mechanism.

A lighter of the aforementioned type is disclosed in WO-A No. 90/12254, in which the means for neutralizing the lighting mechanism consist of a pusher arranged under the actuation end of the tilting lever, movable parallel to the longitudinal axis of this tilting lever, between an active position in which it projects beyond the actuating end of the lever and a nonobstructing position in which it is pushed back in the direction of the other end of the tilting lever, this pusher being provided with means for guiding with respect to the body of the lighter.

According to this known prior document, the pusher has the shape of a horseshoe, each lateral branch of which, made from an elastic material, carries a boss which is normally situated under a skirt bordering the actuation end of the tilting lever in a manner so as to prevent it from tilting in the direction for opening the valve, complementary converging ramps being made on the internal faces of the lateral walls of the body of the lighter and on the ends of the branches of the pusher so as to bring about a reduction in the spread of their bosses when the pusher is displaced into the nonobstructing position, in a manner such as totally to free the path of the skirt from the actuation end of the tilting lever while the pusher and the outer rear face of the skirt of the actuation end of the tilting lever have complementary ramps of like slope, able to interact, when this end of the tilting lever is pushed in, so as to bring about the displacement, in the opposite direction, of the pusher into its active neutralization position.

It can easily be understood that the complexity of the shape of this pusher and of the complementary shape of the upper part of the body of this lighter considerably increases its cost.

U.S. Pat. No. 4,832,596 discloses a lighter in which the means for opening the valve consist of a tilting lever articulated to a fixed pin orthogonal to the axis of the burner valve, one end of which lever, in the shape of a fork or a ring, is engaged under a collar of the burner valve and the other end, or actuation end, of which is intended to be actuated by the user by being pushed in the direction of the body of the lighter, counter to the force of a return spring, the means for producing sparks themselves being independent or combined with the lever for opening the valve, and in which there are combined with the lighting mechanism means for neutralizing this mechanism, which means consist of a member movable between an active neutralization position in which it prevents the actuation of the control lever for opening the valve, having a part located under the rear actuation end of this lever, and a nonobstructing position, in which it allows this actuation, this member, which can be displaced, manually, by the user, from its active neutralization position to its nonobstructing position, and which is normally kept in the neutralization position, being, moreover, arranged so as to be returned automatically into the neutralization position after actuation of the lighting mechanism.

In this lighter, the moving member consists of a member mounted so as to slide laterally at the upper edge of its body, and which has a bent rear end normally situated under the rear actuation end of the control lever, this bent rear end being able to be pushed back beyond the rear actuation end of the control lever, into the neutral position of this sliding member.

In this lighter, the sliding member is normally kept in the active position by a return spring and may be displaced into the neutral position by a pressure exerted on its front end.

Consequently, when the lighter is lit, it is necessary to keep the sliding member in the neutral position at the same time as the control lever is actuated, which is not easy to achieve with just one hand.

In addition, since it is mounted laterally at the top of the lighter, this sliding member is exposed to the risk of being damaged or spoilt.

Finally, its return to the active position is dependent on the presence of its return spring and, since the latter is also very exposed, there are risks that it might get lost and that consequently its function might no longer be fulfilled, which would lead to the lighter losing its "childproof" nature.

SUMMARY OF THE INVENTION

The present invention aims to provide a gas-filled lighter which is childproof, at a price which is considerably less than the aforementioned known one but which has at least the equivalent operational safety.

For this purpose, in the lighter to which it relates and which is of the aforementioned type in which the means for opening the valve consist of a tilting lever, the member for neutralizing the tilting lever consists of a pusher mounted so as to slide against the lower face of the rear actuation end of the control lever, whose movements it follows, and movable between a withdrawn active position in which, since it is projecting beyond the rear end of the control lever, a part integral with the body of the lighter is situated just below it, making any maneuver of the control lever impossible in the direction for opening the valve, and an advanced and nonobstructing position, in which the aforementioned part of the body of the lighter is no longer in the path described by the pusher when the control lever is maneuvered in the direction for opening the valve, making this maneuver possible, means being provided for ensuring that the pusher is momentarily kept in the nonobstructing position before actuation of the control lever and other means being provided to ensure that it returns to the active neutralization position immediately after this actuation.

According to a simple embodiment of the invention, the pusher is placed between two lateral longitudinal ribs bordering the lower face of the rear end of the control lever and delimiting, under the rear end of this lever, a groove of the same width as it and guiding it, this pusher being interposed between the bottom of this groove and the upper end of the spring for returning the control lever into the position for closing the valve, this spring holding it against the bottom of the aforementioned groove.

According to a preferred embodiment of the invention, in order to improve the behavior of the pusher in its guide groove, the spring for returning the lever is helical and its upper end is engaged on a peg securely fastened to the lower face of the pusher whereas its lower end is engaged on a peg securely fastened to a transverse wall of the body of the lighter.

Preferably, the means for momentarily keeping the pusher in the advanced and nonobstructing position consist of a ridge and notch set provided, respectively, one at the front end of the bottom of the groove for guiding the pusher and the other at the front end of the upper face of the pusher and situated, with respect to one another, in such a fashion as to allow their mutual engagement when the pusher is displaced from its active withdrawn position to its advanced nonobstructing position, this engagement being maintained by the force of the control lever return spring, in the absence of any other force communicated to the control lever.

In this case, advantageously, the means for automatically returning the pusher into the active neutralization position, immediately after actuation of the control lever in the direction for opening the valve, consist, on the one hand, of a rigid skirt bordering the rear end of the lower face of the pusher and intended to bear against the lower end of the spring for returning the control lever, which lower end is engaged on its fixed guide peg, before the end of the angular travel of the control lever in the direction for opening the valve, which has the effect, due to the stopping of the angular travel of the pusher, of disengaging the ridge and the notch with which the bottom of the groove for guiding the pusher and the upper face of the latter are provided, from one another, and, on the other hand, by two ramps oriented suitably so as to act as cams, and provided respectively in the bottom of the groove for guiding the pusher and on the upper face of the latter, to the rear of the aforementioned ridge and notch, and intended to come into contact with one another immediately after the disengagement of the ridge and of the notch so as to participate, following the pressure generated by the action of the spring for returning the control lever, in the withdrawal movement of the pusher into its active neutralization position.

It should be noted that the stiffness of the spring for returning the control lever, the ends of which are engaged over the pegs, one of which is fixed and the other securely fastened to the pusher, participates in the forces for returning the pusher into the withdrawn active neutralization position.

Preferably, the front face of the lower and rigid rear skirt of the pusher is shaped so as to match the curved shape of the spring for returning the control lever when the pusher occupies its advanced and nonobstructing position.

Thus, by virtue of its additional deformation due to the pusher, in the tilted position of the control lever, this spring also has the function of returning the pusher into the withdrawn and active position as soon as the control lever is freed.

Advantageously, the rear face of the pusher has a step, oriented downwards and intended to constitute the part of the pusher intended to come into contact with the complementary abutment face of the body of the lighter when the pusher is in the withdrawn active position in order to oppose any maneuvering of the control lever for opening the burner valve.

According to a first embodiment of the invention, the part of the body of the lighter situated just below the rear end of the pusher consists of the upper edge of the rear wall of the body of the lighter.

In a variant, this part of the body of the lighter consists of a shoulder provided, for this purpose, in the vicinity of the upper end of the inner face of the part of the wall of the body of the lighter situated below the pusher.

Regardless of which part of the body of the lighter the step of the pusher bears against, this step risks, in the event of excessive pressures exerted on the control lever, becoming chamfered and no longer fulfilling its safety role. On the contrary, its possible chamfering risks bringing about the untimely foward displacement of the pusher, as far as its advanced and nonobstructing position, following the reaction of the chamfer against the stop belonging to the body of the lighter.

In order to eliminate this risk, according to an improved embodiment of the invention, one of the sliding contact faces of the pusher and of the rear end of the control lever has at least one projection and the other at least one hollow, arranged in such a manner that each projection is engaged in the corresponding hollow in the withdrawn active position of the pusher.

Thus, even an exaggerated pressure on the rear actuation end of the lever cannot bring about the advancement of the pusher into the nonobstructing position. On the contrary, such a pressure can only increase the interpenetration of the projections and hollows which opposes any displacement of the pusher with respect to the lever.

Advantageously, the upper sliding contact face of the pusher has a longitudinal slot and the lower face of the rear end of the control lever, against which face the pusher slides, carries a guide stud constantly engaged in this slot.

In this case, the projection improving the retention of the pusher in the active withdrawn position is carried by the upper sliding contact face of the pusher and it consists of the two ends of a transverse rib broken by the longitudinal slot of the pusher whereas the hollow is provided in the lower face of the rear end of the control lever and it consists of a transverse groove able to house the rib of the pusher when the latter is in the active withdrawn neutralization position.

BRIEF DESCRIPTION OF THE DRAWING

In any case, the invention will be well understood, with the aid of the description which follows, referring to the appended diagrammatic drawing representing, by way of non-limiting examples, two embodiments of this lighter only the upper end of whose body carrying the head of the lighter is represented in the drawing:

FIGS. 1 and 2 are sectional views respectively along I—I of FIG. 2 and II—II of FIG. 1, of a first embodiment of this lighter, with its control lever in the normal rest position and the pusher in the position for neutralizing the control lever;

FIG. 3 is a view in perspective showing the pusher of this lighter;

FIG. 4 is a view similar to FIG. 1 showing the pusher in the advanced nonobstructing position and consequently the position for freeing the control lever, the latter still being in the normal rest position;

DESCRIPTION OF THE PREFERRED EMBODIMENTS

Figure 5:
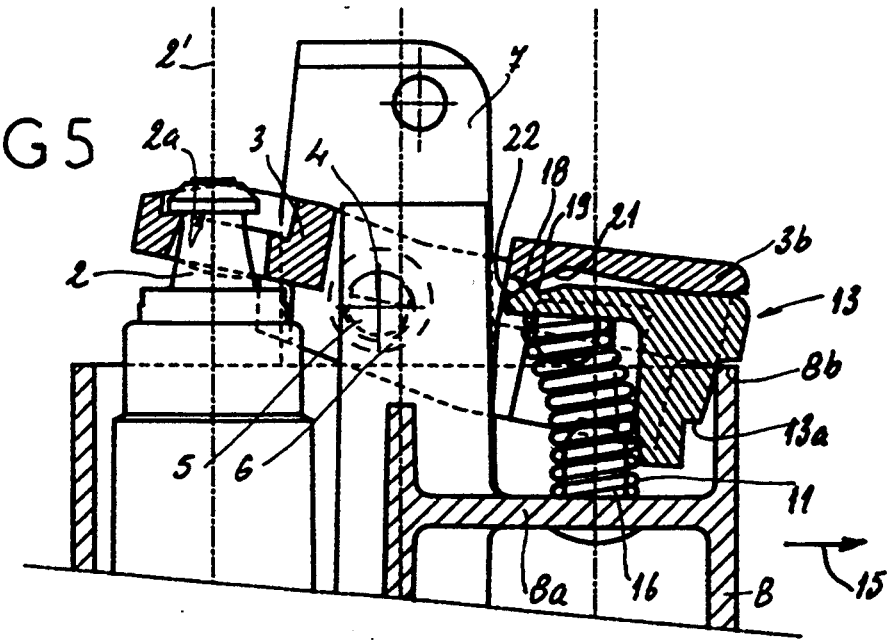
FIG. 5 is a view similar to both FIGS. 1 and 4 showing the control lever at the end of actuation travel, that is to say in the position for opening the valve.

As shown in the drawing, the lighter according to the invention is of the type in which the means for opening the burner valve 2 consist of a tilting lever 3 articulated to a fixed pin 4 orthogonal to the axis 2' of the burner valve 2, by means of two journals 5 which it carries laterally, in its median part, and which are engaged in hubs 6 made in a clevis whose wings 7 are securely fastened to the body 8 of the lighter. One end **3*a* of the tilting lever 3, in the form of a ring, is engaged under a collar 2*a* of the burner valve 2 in a manner such as to be able to open the burner valve 2 by lifting up the valve when the other end or rear actuation end 3*b* of the lever 3 is pushed in the direction of the body 8 of the lighter, as illustrated by the arrow 9. A helical spring 11, compressed between a transverse wall 8*a* of the body 8 of the lighter and the lower face of the actuation end 3*b* of the tilting lever 3, tends constantly to move this end of the body 8 away and, consequently, to return the burner valve 2** into the valve-closed position.

In the drawing, the spark-production means have not been represented. These means can be quite simply of the knurled wheel and pyrophoric stone type, and the knurled wheel and its drivers can be mounted on a pin 12 parallel to the pin 4 of the tilting lever 3 and carried, above it, by the wings 7 of the same clevis, such that after actuation of the knurled wheel, the user's thumb falls onto the actuation end **3*b* of the lever 3, bringing about, immediately after the production of sparks, the opening of the burner valve 2** and the lighting of the flame.

In this lighter, the means for neutralizing the lighting mechanism are arranged so as to oppose the actuation of the tilting lever 3 in the direction of the arrow 9. These neutralization means consist of a pusher 13 mounted so as to slide, in the direction of the arrows 14 and 15 parallel to the longitudinal axis of the lever 3 against the lower face of the rear end **3*b* of the latter. For this purpose, the pusher 13 is mounted between two lateral longitudinal ribs 3*c* bordering the lower face of the rear end 3*b* of the control lever 3 and delimiting, under this rear end, a groove 3*d* of the same width as the pusher 13 and guiding it during its displacement in the direction of the arrows 14 and 15**.

As the drawing shows, the lower end of the spring 11 for returning the control lever 3 into the normal rest position is engaged on a vertical peg 16 securely fastened to the transverse partitioning wall **8*a* of the body of the lighter whereas the upper end of this spring 11 is engaged on a vertical peg 17 carried by the lower face of the pusher 13. As can easily be understood, the elasticity and flexibility of the spring 11 does not oppose the displacement of the pusher 13 in the direction of the arrows 14 and 15 but, in contrast, it ensures that it is applied against the groove 3*d*** which serves to guide it.

In the normal rest position, as illustrated in FIG. 1, the pusher 13 is in the withdrawn position, a position in which a shoulder **13*a*, turned downwards, and made in its rear face, is bearing against the upper edge 8*b* of the rear part of the wall of the body 8. In this position, the pusher 13 which is interposed, practically without clearance, between the aforementioned edge 8*b* of the wall of the body 8 and the lower face of the rear end 3*b* of the lever 3 opposes any displacement of this rear end 3*b* in the direction of the arrow 9, that is to say in the direction corresponding to opening the burner valve 2** and, consequently, to lighting the lighter.

Moreover, as the drawing shows, on the one hand, the bottom of the groove **3*d* made in the lower face of the rear end 3*b* of the lever 3 has, in the vicinity of its front end, a ridge 18 normally situated in front of the front end of the pusher 13 and, on the other hand, the upper face of the latter has, in the vicinity of its front end, a notch 19 intended to be engaged over the aforementioned ridge 18 when the pusher 13 is displaced into the advanced position, that is to say in the direction of the arrow 14. This advanced and nonobstructing position of the pusher 13 is shown in FIG. 4. As an examination of this figure shows, the pusher 13 is normally held in the advanced position by the spring 11 whose force, which acts against the lower face of the pusher 13, tends to keep the notch 19 of the latter engaged over the ridge 18 of the bottom of the groove 3*d* of the lower face of the rear end 3*b* of the lever 3**.

In this position, as FIG. 4 clearly shows, the shoulder **13*a* of the pusher 13 is pushed fully in with respect to the upper edge 8*b* of the rear wall of the body 8 of the lighter. In this position, the pusher 13 therefore no longer opposes the pivoting of the lever 3 when its rear actuation end 3*b* is pushed in the direction of the arrow 9**.

Moreover, the pusher 13 is held in its advanced and nonobstructing position as illustrated in FIG. 4 for as long as no force other than that exerted by the spring 11 acts on the rear end **3*b* of the lever 3**.

On the other hand, when a force is exerted in the direction of the arrow 9, on the rear end **3*b* of the control lever 3, the latter pivots about its pin 4 in the direction corresponding to lifting up the burner valve 2** and, consequently, in the direction corresponding to opening the valve.

During this pivoting of the lever 3, a lower skirt **13*b* which borders the rear edge of the lower face of the pusher 13 comes into contact with the lower end of the spring 11 engaged on the fixed peg 16. As FIG. 5 shows, in this position the pusher 13 can no longer accompany the rear end 3*b* of the control lever 3 in its angular travel and consequently is immobilized whereas the lever 3*b* continues its travel. The result is that the rear end 3*b* of the lever 3 makes a forward translational movement with respect to the pusher 13, bringing about, for this reason, the disengagement of the ridge 18 from the bottom of the groove 3***d* with respect to the notch 19 of the pusher 13.

This disengagement position is perfectly visible in FIG. 5.

It can easily be understood that a release of the control lever 3 has the effect of returning it into the starting position, as illustrated in FIG. 1, under the effect of the spring 11. Furthermore, the latter, which has a natural tendency to resume its straight tubular shape, participates in the return of the freed pusher 13 into the withdrawn neutralization position as illustrated in FIG. 1.

However, in order to make this return of the pusher 13 more systematic, as soon as the control lever 3 is released, there is provided, on the one hand, at the front end of the bottom of the groove 3*d*, a ramp 21 oriented upward and rearward and, at the front end of the pusher 13, a complementary ramp 22 such that after the disengagement of the ridge 18 and of the notch 19, the two ramps 21 and 22, which are pressed against one another by the spring 11, generate a force pushing the 10 pusher 13 back in the direction of the arrow 15, which returns it to the neutralization position.

It has previously been indicated that the advanced and nonobstructing position of the pusher 13 was momentarily ensured by the combined effect of the engagement of the ridge 18 in the notch 19 and the pressure, exerted under the pusher 13, by the spring 11. It should be noted that the objective of momentarily keeping the pusher 13 in this position is to allow the user to release the pusher 13 and to actuate the control lever 3 which can, at this moment, pivot in the direction corresponding to lighting the lighter.

Figure 6:
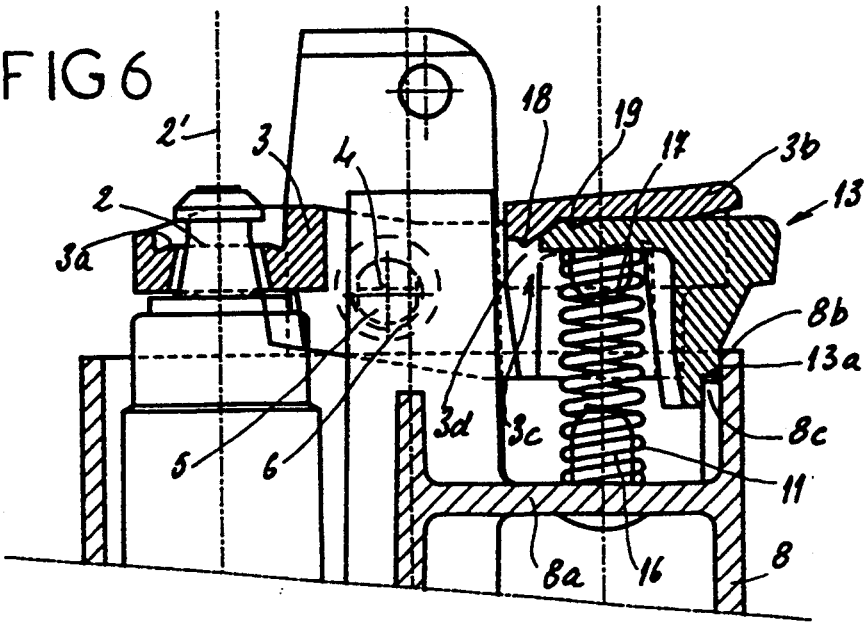
FIGS. 6 to 8 are views similar to FIGS. 1, 4 and 5 respectively, showing a second embodiment of this lighter.
Figure 7:
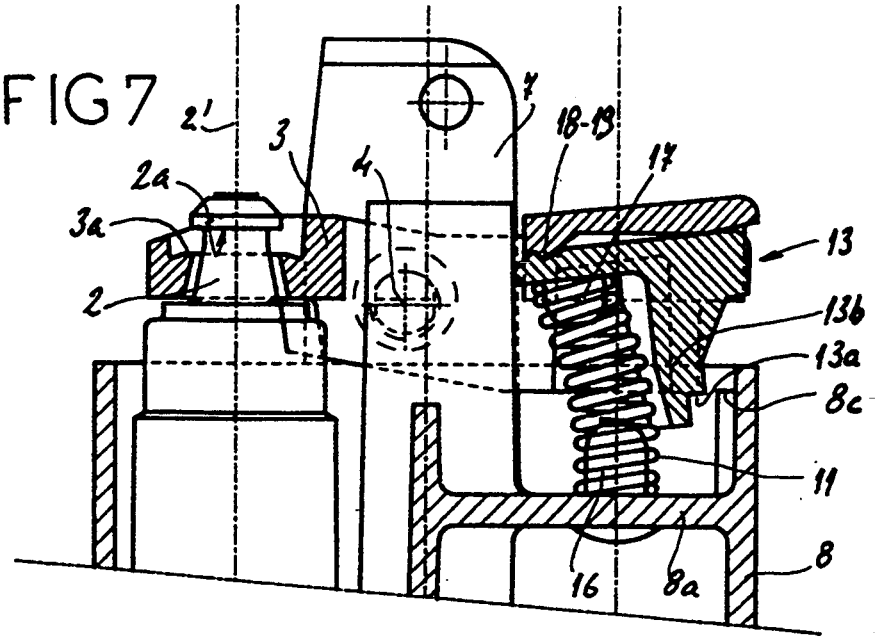
Figure 8:
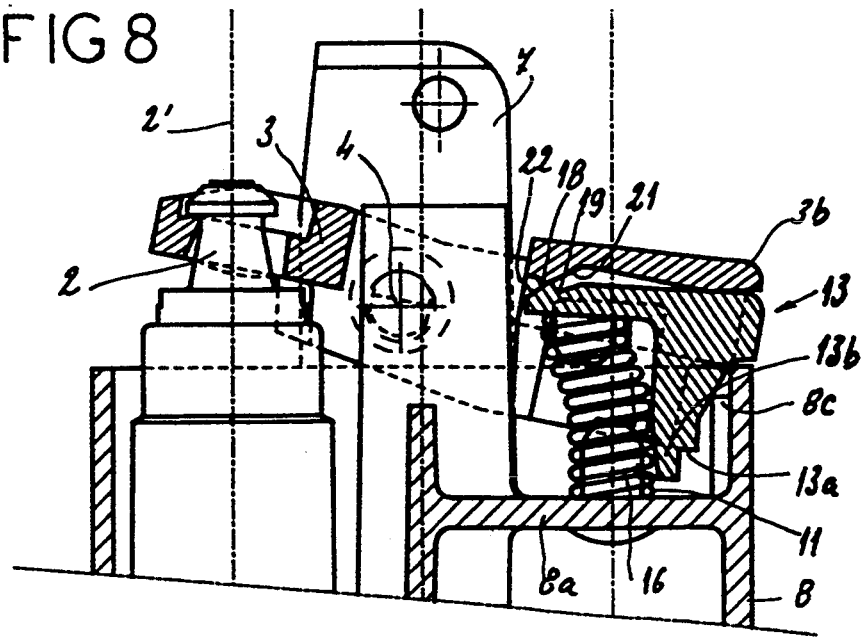

The example illustrated by FIGS. 6 to 8, in which the same elements and parts of elements are denoted by the same references, only differs from the example illustrated by FIGS. 1 to 5 in that the lower shoulder 13*a* of the pusher 13 is intended to bear, in the neutralization position of the control lever 3, not on the upper edge 8*b* of the rear wall of the body 8 of the lighter, but on an internal shoulder 8*c* made, for this reason, against the internal face of this part of the rear wall of the body 8 of the lighter.

Naturally, apart from this minimal difference, the method of operating the lighter of FIGS. 6 to 8 is strictly identical to that of the embodiment illustrated by FIGS. 1 to 5.

Figure 9:
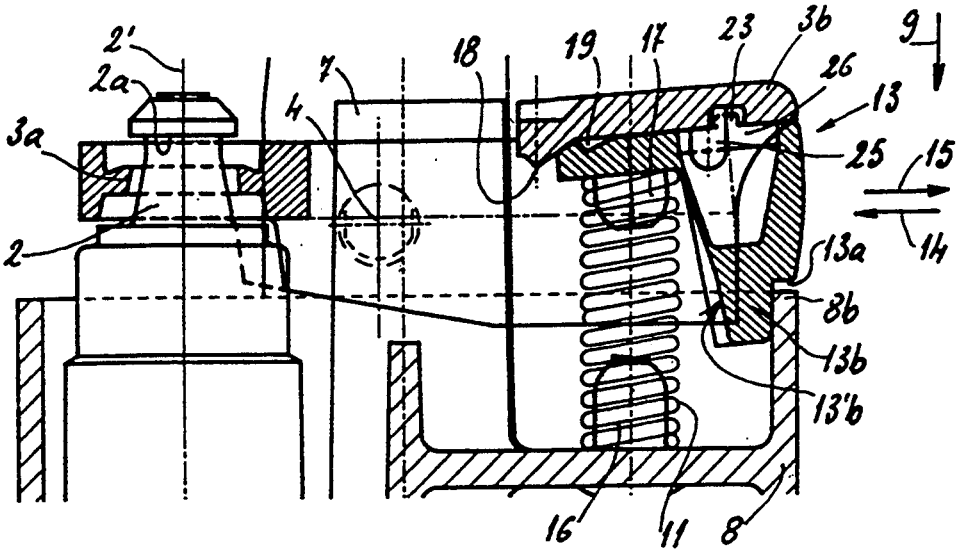
FIGS. 9 to 11 are views similar to FIGS. 1, 4 and 5 respectively, illustrating an improved embodiment of this lighter.
Figure 10:
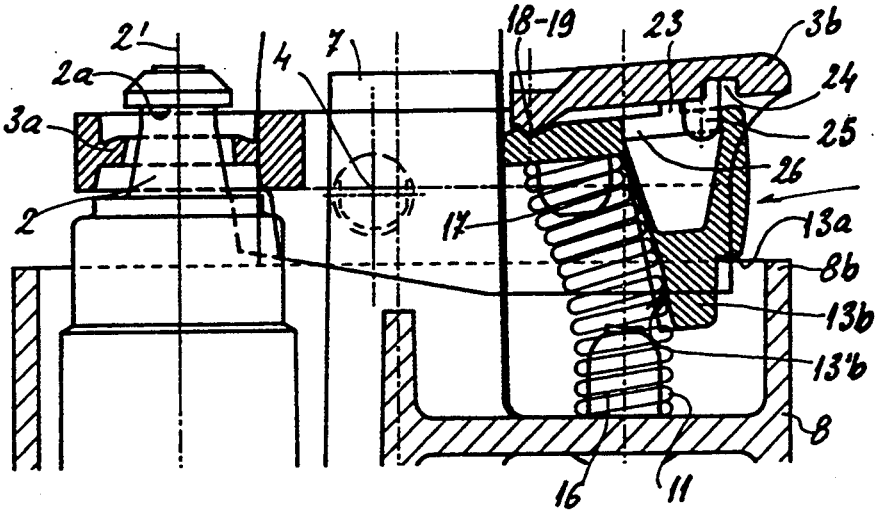
Figure 11:
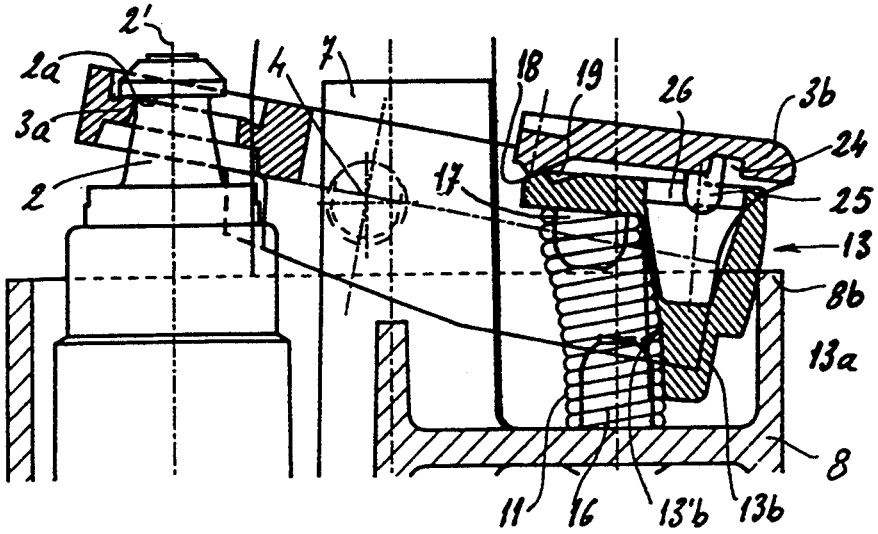

FIGS. 9 to 11 are figures similar to FIGS. 1, 4 and 5 respectively, representing an improved embodiment of the lighter illustrated by FIGS. 1 to 5.

In FIGS. 9 to 11, the same references denote the same components or parts of components as in FIGS. 1 to 5.

Consequently, as in the example illustrated by FIGS. 1 to 5, the abutment face belonging to the body 8 of the lighter consists of a part 8*b* situated under the rear end 3*b* of the control lever 3, on the upper edge of the body 8 of the lighter. The corresponding bearing face of the pusher 13 intended to prevent the maneuvering of the control lever 3 in the direction of the arrow 9 when the pusher 13 is in the active withdrawn neutralization position, as illustrated in FIGS. 1 and 9, consists of an undercut step 13*a* made in the rear face of the rigid rear skirt 13*b* of the pusher 13.

It can easily be understood, by examining FIGS. 1 and 9, that an excessive pressure exerted in the direction of the arrow 9 on the rear end 3*b* of the control lever 3 may cause, by upsetting material, the deformation of the undercut step 13*a* and/or of the upper edge 8*b* of the body of the lighter 8 and may cause them to deform such that their respective ridges become chamfered.

In this case, naturally, a normal force exerted on the rear end 3*b* of the control lever 3 will bring about the displacement of the pusher 13 in the direction of the arrow 14 and, consequently, annihilate the role of this pusher 13 which will automatically be brought into the nonobstructing and inactive position by simply normally maneuvering the control lever 3.

The embodiment illustrated by FIGS. 9 to 11 aims to avoid such a risk.

For this purpose, the upper sliding contact face of the pusher 13, that is to say the face in which the groove 19 is already made for temporarily stopping the pusher in the advanced and inactive position, carries a transverse rib 23. Moreover, the lower face of the rear end 3*b* of the control lever 3, against which face the pusher 13 slides, has a transverse groove 24 able to house the rib 23 when the pusher is in its withdrawn active neutralization position, as illustrated in FIG. 9. Naturally, the groove 24 of the lower face of the rear end 3*b* of the control lever 3 and the rib 23 of the upper sliding contact face of the pusher 13 are arranged in a manner such as to be engaged in one another when the pusher 13 is in the active withdrawn neutralization position, that is to say in the position illustrated in FIG. 9.

It can be easily understood that the interpenetration of the rib 23 and the groove 24 opposes any displacement of the pusher 13 in the direction of the arrow 14, even if a strong pressure is exerted on the rear end 3*b* of the control lever 3, in the direction of the arrow 9. Indeed, such a pressure has the effect of increasing the interpenetration of the rib 23 in the groove 24 and, consequently, of increasing the locking of the pusher 13 in the active withdrawn neutralization position.

On the other hand, it can be understood that owing to the absence, due to the molding, of sharp edges in the zone of the groove 24 and of the rib 23, as well as owing to the floating mounting of the pusher on the spring, this interpenetration cannot prevent the displacement of the pusher 13 in the direction of the arrow 14, when a pressure is exerted on its rear end so as to bring it into the advanced and nonobstructing position.

As FIGS. 9 to 11 show, the lower face of the rear end 3*b* of the control lever 3 carries a guide stud 25 intended to be engaged constantly in a longitudinal slot 26 made in the upper sliding contact face of the pusher 13. The engagement of the stud 25 in the slot 26 has the effect of improving the guidance of the pusher 13 during its two displacements in the direction of the arrow 14 or in the direction of the arrow 15. In this case, the rib 23 is broken by the slot 26 without interference to its function.

Finally, according to another advantageous characteristic of the invention, the front face 13'*b* of the rigid lower and rear skirt 13*b* of the pusher 13 is shaped in a manner such as to be able to match the curved profile of the spring 11 for returning the control lever 3 when the pusher 13 is displaced into the advanced and nonobstructing position, as illustrated in FIG. 10. Indeed, if, in this position of the pusher 13, the front face 13'*b* of its rear skirt 13*b* matches the spring 11, the tilting of the control lever 3 into its position for opening the burner valve 2, as illustrated in FIG. 11, brings about a deformation of the spring 11 which, for this reason, participates in the return of the pusher 13 into the withdrawn active neutralization position, as soon as the user releases the control lever 3.

For, in the position in which the rear end 3*b* of the control lever 3 is pushed in, the deformation of the spring 11 which results therefrom creates an additional force for returning the pusher 13 in the direction of the arrow 15.

I claim:

1. A gas-filled childproof lighter, of the type comprising a body with means for producing sparks and in which means for opening the valve consist of a tilting lever articulated to a fixed pin orthogonal to the axis of a burner valve, one end of which lever, in the shape of a fork or a ring, is engaged under a collar of the burner valve and the other end, or actuation end, of which is intended to be actuated by the user by being pushed in the direction of the body of the lighter, counter to the force of a return spring, the means for producing sparks themselves being independent or combined with the lever for opening the valve, and in which there are combined with the tilting lever means for neutralizing this lever, which means consist of a member movable between an active neutralization position, in which it prevents the actuation of the control lever for opening the valve, having a part located under the rear actuation end of this lever, and a nonobstructing position in which allows this actuation, this member, which can be displaced, manually, by the user, from its active neutralization position to its nonobstructing position, and which is normally kept in the neutralization position, being, moreover, arranged so as to be returned automatically into the neutralization position after actuation of the lighting mechanism, wherein the member for neutralizing the tilting lever consists of a pusher mounted so as to slide against the lower face of the rear actuation end of the control lever, whose movement it follows, and movable between a withdrawn active position in which, since it is projecting beyond the rear end of the control lever, a part integral with the body of the lighter is situated just below it, making any maneuver of the control lever impossible in the direction for opening the valve, and an advanced and nonobstructing position, in which the aforementioned part of the body of the lighter is no longer in the path described by the pusher when the control lever is maneuvered in the direction for opening the valve, making this maneuver possible, means being provided for ensuring that the pusher is momentarily kept in the nonobstructing position before actuation of the control lever and other means being provided to ensure that it returns to the active neutralization position immediately after this actuation.

2. The gas-filled lighter as claimed in claim 1, wherein the pusher is placed between two lateral longitudinal ribs bordering the lower face of the rear end of the control lever and delimiting, under the rear end of this lever, a groove of the same width as it and guiding it, this pusher being interposed between the bottom of this groove and the upper end of the spring for returning the control lever into the position for closing the valve, this spring holding it against the bottom of the aforementioned groove.

3. The lighter as claimed in claim 1, wherein the spring for returning the lever is helical and its upper end is engaged on a peg securely fastened to the lower face of the pusher whereas its lower end is engaged on a peg securely fastened to a transverse wall of the body of the lighter.

4. The lighter as claimed in claim 1, wherein the means for momentarily keeping the pusher in the advanced and nonobstructing position consist of a ridge and notch set provided, respectively, one at the front end of the bottom of a groove for guiding the pusher and the other at the front end of the upper face of the pusher and situated, with respect to one another, in such a fashion as to allow their mutual engagement when the pusher is displaced from its active withdrawn position to its advanced nonobstructing position, this engagement being maintained by the force of the control lever return spring, in the absence of any other force communicated to the control lever.

5. The lighter as claimed in claim 4, wherein the means for automatically returning the pusher into the active neutralization position, immediately after actuation of the control lever in the direction for opening the valve, consist, on the one hand, of a rigid skirt bordering the rear end of the lower face of the pusher and intended to bear against the lower end of the spring for returning the control lever, which lower end is engaged on a fixed guide peg, before the end of the angular travel of the control lever in the direction for opening the valve, which has the effect, due to the stopping of the angular travel of the pusher, of 10 disengaging the ridge and the notch with which the bottom of the groove for guiding the pusher and the upper face of the latter are provided, from one another, and, on the other hand, by two ramps oriented suitably so as to act as cams, and provided respectively in the bottom of the groove for guiding the pusher and on the upper face of the latter, to the rear of the aforementioned ridge and notch, and intended to come into contact with one another immediately after the disengagement of the ridge and of the notch so as to participate, following the pressure generated by the action of the spring for returning the control lever, in the withdrawal movement of the pusher into its active neutralization position.

6. The lighter as claimed in claim 1, wherein the part of the body of the lighter situated Just below the rear end of the pusher consists of the upper edge of the rear wall of the body of the lighter.

7. The lighter as claimed in claim 1, wherein the part of the body of the lighter situated Just below the rear end of the pusher consists of a shoulder provided, for this purpose, in the vicinity of the upper end of the inner face of the part of the wall of the body of the lighter situated below the pusher.

8. The lighter as claimed in claim 1, wherein the front face of the lower and rigid rear skirt of the pusher is shaped so as to match the curved shape of the spring for returning the control lever when the pusher occupies its advanced and nonobstructing position.

9. The lighter as claimed in claim 1, wherein one of the sliding contact faces of the pusher and of the rear end of the control lever has at least one projection and the other at least one hollow, arranged in such a manner that each projection is engaged in the corresponding hollow in the withdrawn active position of the pusher.

10. The lighter as claimed in claim 9, wherein the upper sliding contact face of the pusher has a longitudinal slot and the lower face of the rear end of the control lever, against which face the pusher slides, carries a guide stud constantly engaged in this slot.

11. The lighter as claimed in claim 9, wherein the projection improving the retention of the pusher in the active withdrawn position is carried by the upper sliding contact face of the pusher and it consists of the two ends of a transverse rib broken by the longitudinal slot of the pusher whereas the hollow is provided in the lower face of the rear end of the control lever and it consists of a transverse groove able to house the rib of the pusher when the latter is in the active withdrawn neutralization position.

12. A childproof lighter comprising:

a housing adapted to hold a supply of combustible fuel;

valve means including a valve on the housing between the nozzle and the supply and actuatable to emit the fuel;

ignition means on the housing adjacent the valve actuatable for igniting the fuel;

an actuating lever displaceable longitudinally on the housing between an upper position and a lower position and coupled to the valve and ignition means for actuating same when depressed into the lower position and thereby releasing the fuel and igniting the released fuel, the actuating lever being formed with a lower surface and the housing being formed adjacent the lower surface with an upwardly directed abutment part;

a pusher longitudinally jointly displaceable with the lever and transversely slidable on the lower surface of the lever between a rear neutralizing position downwardly engageable with the abutment part and preventing longitudinal downward movement of the actuating lever into the lower position and a forward nonobstructing position permitting the lever to move longitudinally downward into the lower position;

retaining means including formations one of which is on the pusher for engaging together and retaining the pusher in the nonobstructing position when displaced transversely thereinto; and return means connected to the pusher for disengaging the formations and urging the pusher into its rear neutralizing position on displacement of the lever into its lower position.

13. The childproof lighter defined in claim 12 wherein the lower surface is formed with a transversely extending groove in which the pusher can slide transversely between its positions.

14. The childproof lighter defined in claim 12 wherein the pusher is in the rear neutralizing position projects transversely and rearwardly past the lever.

15. The childproof lighter defined in claim 12, further comprising spring means urging the lever into the upper position.

16. The childproof lighter defined in claim 15 wherein the return means includes a cam formation on the pusher and engageable with the spring.

17. The childproof lighter defined in claim 12 wherein the formations include a longitudinally projecting notch and a longitudinally open groove in which the notch is receivable in the front nonobstructing position of the pusher.

* * * * *